US005204686A

United States Patent [19]

Petrelis et al.

[11] Patent Number: 5,204,686

[45] Date of Patent: Apr. 20, 1993

[54] RF FEED ARRAY

[75] Inventors: Peter G. Petrelis, Huntington Beach; William C. Wong, Palos Verdes, both of Calif.

[73] Assignee: TRW Inc., Redondo Beach, Calif.

[21] Appl. No.: 178,689

[22] Filed: Apr. 6, 1988

[51] Int. Cl.[5] ..... H01Q 3/02; H01Q 3/22

[52] U.S. Cl. ..... 342/374; 342/372

[58] Field of Search ..... 342/367, 368, 371, 372, 342/374

[56] References Cited

U.S. PATENT DOCUMENTS

| | | | |
|---|---|---|---|
| 3,553,706 | 1/1971 | Charlton | 343/777 |
| 3,886,547 | 5/1975 | Bottenberg | 343/100 |
| 4,101,901 | 7/1978 | Kommrusch | 343/853 |
| 4,101,902 | 7/1978 | Trigon | 343/854 |
| 4,121,221 | 10/1978 | Meadows | 343/854 |
| 4,124,852 | 11/1978 | Steudel | 343/854 |
| 4,188,578 | 2/1980 | Reudink et al. | 325/4 |
| 4,277,789 | 7/1981 | King | 342/374 |
| 4,652,880 | 3/1987 | Moeller et al. | 342/373 |

FOREIGN PATENT DOCUMENTS

| | | | |
|---|---|---|---|
| 790756 | 7/1968 | Canada | 342/374 |
| 0141805 | 11/1980 | Japan | 342/368 |

*Primary Examiner*—Gregory C. Issing

*Attorney, Agent, or Firm*—Ronald M. Goldman; Ronald L. Taylor

[57] ABSTRACT

An RF radiating system possesses high efficiency and reliability, including built in rain margin capability, in a structure that associates a plurality of solid state RF amplifiers with an antenna in an antenna array. In a specific aspect the system comprises a plurality of sources of RF carrier signals of at least two different frequencies; and radiating means for radiating an RF signal of a given frequency in multiple power levels in a first directionally steerable beam and for alternately or simultaneously radiating at least one additional RF signal of a different frequency in a directionally steerable beam separate from said first beam; said last named means including a plurality of discrete solid state amplifier means for coupling and amplifying signals from said source to said radiating means.

6 Claims, 3 Drawing Sheets

RF FEED ARRAY

FIELD OF THE INVENTION

This invention relates to RF transmitting feed or array systems and, more particularly, to a satellite RF downlink communications amplification and transmitting system capable of transmitting multiple frequencies at selective power levels with improved efficiency, reliability and versatility.

BACKGROUND

Radio communications links serve to receive, amplify and "repeat" or transmit "wirelessly" through the air modulated radio and microwave frequency, RF, signals originating from a remotely located transmitter to the next distant RF "repeater" in the link or, alternatively, to the end of the link, the intended distant RF receiver, the latter of which uses the signal or processes it in known ways for conventional purposes. These wireless RF links serve as the backbone of modern radio, television, data and telephone communication. The geosynchronized orbiting satellite is one known vehicle used to carry RF communications repeater equipment, including the component amplifiers and antennas, and the airborne equipment is used as a communications link between a transmitter located at one location on the earth and a receiver located at another location on the earth and, vice-versa.

In a geosynchronous orbit the satellite as viewed from the earth appears stationary or fixed in position. Hence a directional antenna in a ground transmitting station, such as a parabolic antenna or phased array antenna, is aimed at the satellite, and the antenna radiates RF energy of a given frequency supplied to the feed by a transmitter. That RF energy is received at the satellites receiving antenna, at a reduced power level, due to losses occurring in the passage through space and through medium attenuation. The associated amplifiers carried in the satellite amplify the received signal and typically convert it to a slightly different frequency. This signal is them coupled to a transmitting antenna from which it is radiated into space toward the earth, the communications "downlink". The transmitting or sending antenna is a directional antenna, one which concentrates or focuses the energy to a limited area, and is aimed at an earth ground station. As examples antennas such as parabolic reflector, lens, phased array, or equivalent aperture antenna, all of which are known, are useful in that application. The RF energy accordingly is propagated through space to the ground station: or, more accurately, to an area or "footprint" on the earth containing the ground station.

Although a single RF signal was described in the preceding instruction, more typically a number of RF signals of different frequencies, forming different channels or carriers, are simultaneously transmitted, "multiplexed", and are simultaneously received so that larger amounts of information may be handled by the communications link in a given period of time. The merits of such satellite communication, which provide a kind of direct line of sight communication, over prior methods and technology includes lower cost and more effective communication. Those advantages are known and need not be considered further in this brief introduction to the background to the present invention. The limitations in that existing system is a greater interest. The present invention minimizes such limitations to enhance the reliability and efficiency of that communications link.

In most downlink communications systems multiple carrier frequencies are amplified separately by individual high power amplifiers such as traveling wave tube amplifiers or high power solid state amplifiers ("HPSSA") which combine in a power combiner the output of several solid state devices. To date, the traveling wave tube amplifier or "TWTA" as more often labeled has been the amplifier of choice in this application. The TWTA is an amplifier which contains a vacuum tube known as a traveling wave tube. This is a unique microwave vacuum tube device which relies upon the phenomena of slowing down a propagating RF signal inputted to the device and applied to an internal "slow wave" circuit structure by means of which the propagating RF signal extracts energy and is amplified in an "electronic interaction" process from electrons moving in the vacuum envelope between a cathode and anode under an electrostatic acceleration force created by a high dc voltage applied between the anode and cathode elements. The amplified RF signal continues along the slow wave circuit and is output from the TWTA. The reader is referred to the technical literature for additional details of this amplifier device.

TWTAs presently used in this application provide practical conversion efficiencies from the direct current, dc; that is the power extracted from the dc power supply and consumed, to RF output power that is on the order of twenty five per cent or larger at frequencies of twenty GHz in wideband operation; that is operation in which the TWTA is used to amplify a single signal contained within a wide bandwidth frequency range, one generally regarded as greater than 10% bandwidth by those skilled in the art. In order to maintain high power amplifier efficiency, a separate HPA is required for each signal to minimize generation of interference products between the signals. The overall efficiency referenced to the antenna, however, is degraded by losses in the transmission path required between the output of the TWTA and the antenna feed, those occurring from the necessary inclusion in that RF path in practical systems of redundancy switches, those which serve to provide reliable operation in the event of a failure of a HPA and multiple signal combining mutiplexer and diplexer filter losses, and long waveguide runs to the antenna feed. The same factors also apply to high power solid state amplifiers.

Another possible method seldom used employs a single very high power TWTA to amplify multiple RF carrier signals. This alternative requires the TWTA's output power to be purposely lowered in order that the amplifier operates in a quasi-linear mode to maintain between the several RF carriers being amplified a low intermodulation interference, the undesirable distortion causing transfer of some portion of one signal of one channel to a different signal in another channel. As a consequence the overall efficiency in this arrangement is reduced by a factor of two as compared to the system aforedescribed using a single TWTA for each carrier frequency.

A significant practical factor that impacts efficiency in those TWTA systems is bad weather. Bad weather interferes with RF transmission. It is vital to maintain reliable communications to the ground station despite the existence of rain or snow at that receiving site. To handle that situation the communication system designers apply a "rain margin" into the transmitter's design, sizing the transmitter power depending on frequency and permitted bad weather outage by at least ten dB above that power necessary for reliable communications needed in clear weather. TWTAs for this application are thus sized to provide a power output that is at least ten times larger, ie. 10 dB, than clear weather requirements. Consequently the TWTA consumes ten times the dc power consumption as would be consumed if the system were designed for good weather operation only. This necessary design is inherently inefficient.

Attempts to mitigate the inefficiency in the high power single TWTA approach by technical gimmicks or designs to make the output power "programmable" result in increased expense and complexity, questionable reliability and overall lower TWTA operational efficiency, although achieving some savings in dc power consumption at lower power levels.

A principal object of the invention is to increase the electrical efficiency of communications systems downlink RF amplifiers. The present invention provides a new amplifier architecture that eliminates the need for traveling wave tube amplifiers or single HPA HPSSA and the attendant system inefficiency. The invention introduces very high solid state semiconductor reliability and flexibility and efficiency not heretofore possible as a practical matter with high power amplifier systems. The overall dc conversion efficiency referenced to the antenna feed of the amplifier system is increased over that available with TWTAs despite the fact that the efficiency of the individual solid state amplifiers employed as part of the system is less than that of an individual TWTA.

SUMMARY OF THE INVENTION

An elemental radiating system according to one aspect of the invention employs a plurality of modules each containing a controllable phase shifting circuit feeding into an associated one of a plurality of solid state RF amplifiers. The output of each RF amplifier is connected to a corresponding one of a plurality of RF radiator elements, such as a horn antenna. And means are provided to split the signal to be transmitted, the input signal to the circuit, amongst the inputs to the modules. An additional RF radiating system incorporates a plurality of sources of RF carrier signals of at least two different frequencies; and radiating means for radiating an RF signal of a given frequency in multiple power levels in a first directionally steerable beam and for alternately or simultaneously radiating at least one additional RF signal of a different frequency in a directionally steerable beam that is separate from said first beam; said last named means including a plurality of discrete solid state amplifier means for coupling and amplifying signals from said sources to said radiating means.

The foregoing and additional objects and advantages of the invention together with the structure characteristic thereof, which was only briefly summarized in the foregoing passages, becomes more apparent to those skilled in the art upon reading the detailed description of a preferred embodiment, which follows in this specification, taken together with the illustration thereof presented in the accompanying drawings.

DETAILED DESCRIPTION OF THE PREFERRED EMBODIMENTS

Figure 1:
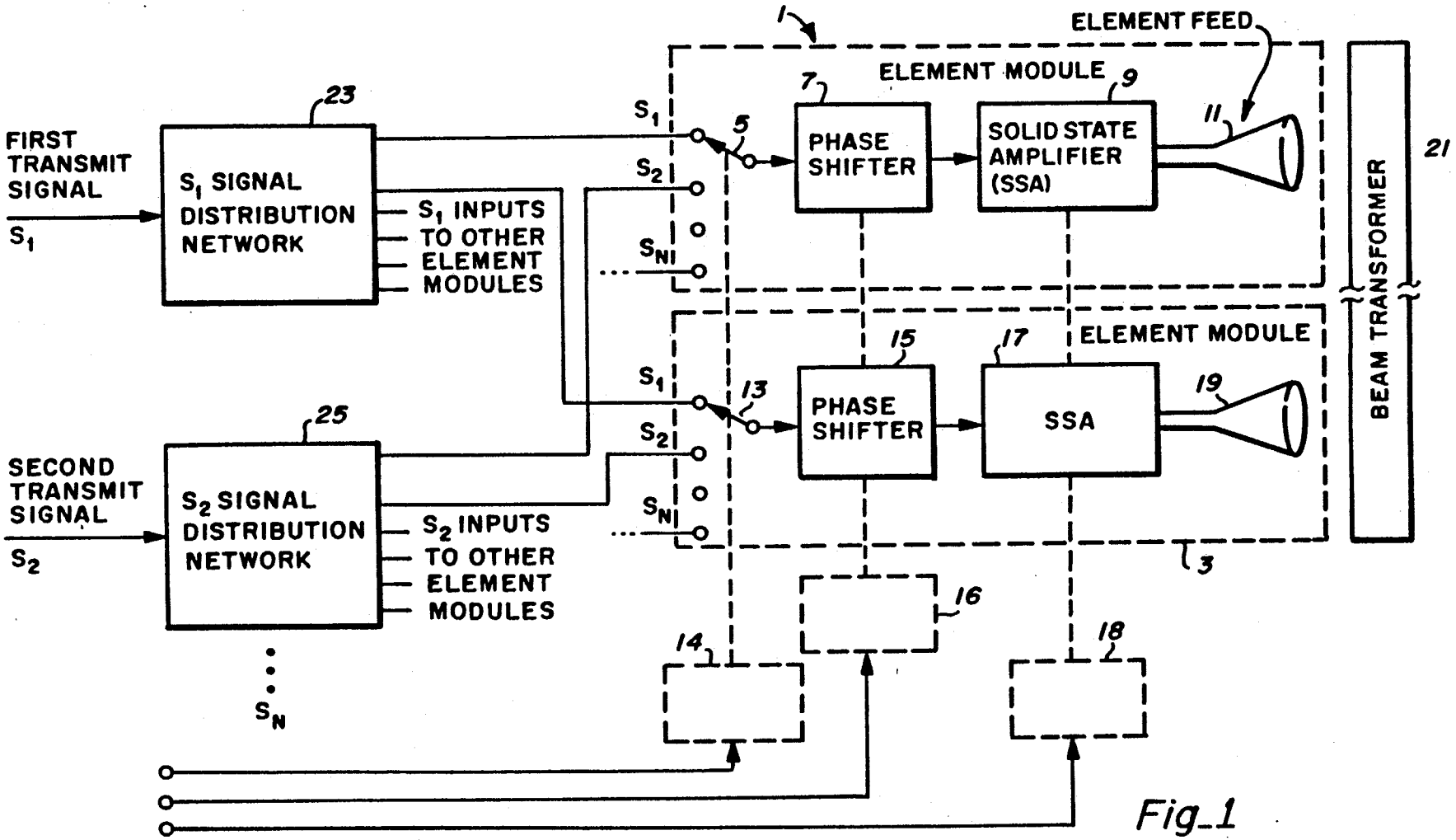
FIG. 1 illustrates the invention in block diagram form.

The downlink communications system represented in FIG. 1 in block diagram includes a series of elemental amplifier modules only two of which, 1 and 3, are illustrated. These modules are represented by the elements enclosed within dash lines in the figure. Module 1 includes a multi-pole switch 5, symbolically represented, a controllable phase shifter 7, solid state amplifier 9 and antenna element feed 11. A like switch 13, controllable phase shifter 15, solid state amplifier 17 and antenna element feed 19 are contained in the second module and in all respects, the second module is essentially identical to the first. Similarly each of the additional nine modules in the embodiment that are not illustrated are of essentially identical structure. It is noted that any number of modules may be used and at least twenty such modules is preferred.

Antenna feed elements 11 and 19 are electromagnetically coupled to a beam transformer 21, which combines outputs of the feed elements from all of the modules, including modules 1 and 3. Alternatively the feed elements, each of which forms a small antenna in and of itself, are arranged in a phased array radiating system, a known structure which is discussed later in this specification. As illustrated to the left in the figure, a signal distribution network 23 is associated with the modules. The network functions to divide a modulated carrier signal, S1, applied at its input to multiple outputs, identified as sl through sy. One such distribution network is provided for each individual carrier signal in the overall system.

The module input at switch 5 includes an input sl through sn, only three of which are illustrated. These are connected to the output of a selected one of the distribution networks.

The output of distribution network 23 is connected to a corresponding input terminal of the selector switch associated with the module, specifically output sl of the first distribution network is connected to input sl of the first module. The remaining outputs of the distribution networks are connected to the corresponding sl inputs of the module selector switches associated with each of the other amplifier modules in the system. Thus if there are y modules, twenty for example, each distribution network should contain twenty outputs. Hence under ideal circumstances, the output of each distribution network associated with an individual carrier signal may be selectively connected to some or all of the Y amplifier modules, depending upon the position in which the modules associated selector switch is placed.

A second distribution network 25 has its input coupled to a source of communications signals, such as a modulated carrier represented as s2. The second distribution network contains a number of outputs y, twenty for example, corresponding in number to the number of amplifier modules in the system. As illustrated in the figure, a first output of the second distribution network is connected to position s2 of switch 5 and a second output is connected to position s2 of switch 13 associated with module 1 and 3. This same connection is made to the s2 pole of the input switches associated with the other amplifier modules, not illustrated in the system.

Each signal distribution network is of a known type which effectively divides the signal between its outputs. The input selector 5 represented schematically in its simplest form as a mechanically positionable switch is preferably an electromechanical or electronic switch which is under control of switch control circuit 14 represented in dash lines. The control circuit 14 is of any conventional type and in effect serves as a switchboard. The control circuit may be coupled to communications receivers in the satellite. The control circuit receives commands specifying each selector switch and the position in which the switch is to be disposed, stores that information and executes those commands causing the switches to be positioned accordingly. As represented by the dash lines, the phase shifters are similarly controlled by on board control circuits represented in dash lines 16. The communications circuits for receiving and processing such command information are old and known and are not further described.

In this circuit the power supply and connections thereto inherent in the circuit are not illustrated since they are conventional and do not contribute to an understanding of the invention.

Figure 2:
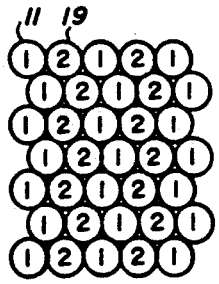
FIG. 2 illustrates the layout of an antenna array used with the carrier frequencies in the embodiment of FIG. 1.

Reference is made to FIG. 2 which consists of a series of circles spatially arranged to represent symbolically a front view of the individual feed elements or antennas associated with the amplifier modules. Only two of those feed elements, antennas 11 and 19, which were illustrated in FIG. 1 are identified in this figure by the same number.

As illustrated the antenna arrangement is essentially a planar array of spatially arranged antenna feeds, numbering thirty-five in the figure. More or less can be used in any general array. In a dual carrier frequency downlink system, which is the example in this embodiment, the portion of the feed elements associated with those modules used in connection with the first carrier frequency are represented in FIG. 2 by the symbol 1. Those feed elements associated with the second carrier frequency are labeled with the number 2. As shown the various rows of feed elements are arranged with the feed elements associated with the first carrier being spaced from one other with a feed element associated with the second carrier frequency being located in between or interleaved with those associated with the first carrier. There are twenty-one antennas associated with the first frequency and fourteen associated with the second frequency in this illustration.

As those skilled in the communications art recognize, the array illustrated is adapted to form a directional beam; that is, the propagation characteristics of the antenna are more selective or emphasized in one direction. This direction may be electronically controlled or "steered" through appropriate phasing techniques known in the art, which are included within the present invention as hereafter discussed in greater detail.

If all of the antennas are supplied with a signal of frequency fl and all such signals are presented to the associated antennas in phase, the propagation characteristics are such as to form a beam that has directional characteristics essentially perpendicular to the surface of the array. If, however, some of those signals are shifted in phase from the others, then the effective beam shifts from the perpendicular direction to another direction. Thus by controlling the electrical phase of the signals propagated to each element in the array, the beam may be electronically controlled in direction. The exact amount of phase shift necessary and the particular radiation direction resulting is well understood by those skilled in the art and need not be explored in detail in this specification.

A second characteristic of the phased array antenna system is that the larger the number of elements in the array the greater is the directional characteristic obtained. Also as the number of elements in the array for a given aperture area is reduced, there is a grating lobe loss. The minimum number of elements in such an array that can be used and still be effectively directionally controlled or "steered" is referred to as a "Thinned Array". In the illustration of FIG. 2, certain elements are associated with a first frequency and other antenna elements are associated with a second frequency. Effectively the arrangement forms two thinned arrays that are interleaved with one another in what physically appears to be a single array. In accordance with the invention, elements assigned to one of the carriers may be varied; increasing the number and therefore the transmitted power associated with the one carrier and concomitant number and power decrease in those associated with the second carrier. For example, all of the antenna elements may be connected to output frequency fl or all connected to output the frequency f2 to the exclusion of the other carrier signal so as to individually or electronically form a single array that is directionally more effective than a thinned array.

The foregoing principles are borne in mind in connection with the discussion of operation of the preferred embodiment. Moreover, as was illustrated in FIG. 1, a beam transformer 1 may be used in combination with the array to even more effectively combine the electromagnetic energy into a beam.

In operation of the embodiment of FIG. 1, the first signal f1 obtained from the associated communication equipment, not illustrated, is distributed amongst the modules and in this illustration provides an input to module I. The second carrier signal, f2, is similarly obtained from that associated equipment and is distributed by network 25 amongst the modules at the associated s2 position of each selector switch. In this illustration carrier f2 is coupled via switch 13 to phase shifter 15, into the solid state amplifier 17 and as amplified the carriers is transmitted via antenna 19 which is arranged as part of the array illustrated in FIG. 2.

Control circuit 16 establishes the amount of phase shift provided by each of the phase shifters in each of the modules according to a predetermined pattern transmitted from the Earth control station. Likewise the selector switches in each of the modules are positioned to the particular input terminals specified by the controller based on the command information supplied by an input communication channel from the Earth station. An advantage of the invention is that each and every antenna array may be connected to radiate any one of the carrier signals. This provides a flexible programmable means of increasing transmitter power for a selected carrier frequency and a degree of individual transmitter beam steering.

Transmitter power overall is determined by the radiated single element power; that is, the output power of the solid state amplifier and the feed element gain, increased by the number of modules connected to the specific input carrier. Beam steering is equivalent to that of a thinned array and is accomplished by appropriate selection of the phase shift 7 of the phase shifters in the associated modules that are carrying the first carrier signal. Each of the solid state amplifiers may be of any conventional design suitable for amplifying the entire range of RF carrier signals intended for use in the communication system. All of the elements in the system including the elements of the antenna must to that extent be sufficiently wide in bandwidth, a wide band type antenna.

The foregoing structure may be compared with that of the prior art TWTA systems. A typical downlink communications system presently employed in satellites is represented in block diagram form in FIG. 3. The system includes sources 61 and 63 that provide modulated carrier frequencies fl and f2, respectively. These sources are the uplink communications receivers that receive the carriers from a ground location. Four TWTA power amplifiers 55, 57, 59 and 61, a multiplexer, such as a diplexer 63 and an antenna 65, containing feed horn 67, reflector 68 and subreflector 69. The subreflector and reflector combination is used to effectively increase the array's "aperture area" to thus make the radiated RF "beam"more directional in character. A double pole single throw switch 62 is provided in the signal path. The switch couples the input signal f1 selectively to the input of TWTA 65 or to the backup TWTA 67. The latter selection is made in the event that the TWTA 65 fails. In like manner a waveguide switch 66, single pole double throw, couples the amplified signal H outputted from TWTA 55 via a waveguide, symbolically illustrated, to an input arm of diplexer 63 via a waveguide linkage 58. In like manner modulated carrier signal f2 is coupled by single pole double throw switch 54 to one of the inputs of the TWTA amplifiers 59 and 61; the former amplifier normally and the latter amplifier only in the case the former amplifier fails. The amplified signal from this path is applied via the output waveguide through a single pole double throw waveguide switch 60. The signal is coupled by waveguide 64 to the second input arm of diplexer 63.

The diplexer is a two arm type multiplexer of known structure which allows signals of different frequencies to be combined into a common line without interference and with essentially no loss or very limited signal level loss. That is, signals inputted to arm 63*b* cannot pass out the input end of arm 63*a*. Instead the signals extend or pass through the diplexer's output. In the prior art system represented in the figure, the several RF carriers are coupled to a single antenna. In other systems where space permits, it is conceivable for multiple antennas to be used, one antenna for each communications channel. Such a theoretical alternative system eliminates the need for diplexer 63. Though theoretically possible the alternative is not regarded as practical due to space and weight limitations available in the satellite.

The present state of the technology provides efficient and reliable solid state RF amplifiers capable of providing power levels on the order of 2-½ watts at 20 GHz. While this individual amplifier output power is small in comparison to that obtained with a conventional and larger traveling wave tube amplifier, the solid state modules in accordance with the teachings of this invention are effectively combined in space as individual radiation from the separate antenna array elements. Thus ten of the 2-½ watt amplifiers effectively radiates power of the same level as the single TWTA.

It is highly unlikely for inclement weather to simultaneously occur at physically separate multiple ground station locations on the Earth. Hence, if the two carrier signals are transmitted to two different locations, a significant advantage can be taken of the rain margin relative to that available in existing single TWTA systems. The individual solid state amplifier modules in the improved system may be transferred for use with or shared between any of the carrier signals to provide for rain margin on command as and when needed. For example, if the fair weather power required is 2-½ watts and a 25 watt level is required for rain margin, then ten of the amplifier modules may be switched into the circuit for the carrier signal intended for that first rain covered location, leaving but a single module to provide the 2-½ watts power required to reach the second clear weather location. In an existing TWTA system, a 25 watt TWT amplifier is normally used on all occasions in rainy or clear weather. If there are two carrier signals required to be transmitted, then two 25 watt TWTAs are required in those systems, providing a total transmitter power of 50 watts. Moreover, at least one shared or two additional TWTAs are used in the satellite to provide redundancy or backup should either of the primary TWTAs fail in service.

With the invention an active module power output of 2-½ watts is provided for each transmitted signal and only 22-½ watts of additional power is required to handle the rain margin for both if rainfall does not occur at both locations simultaneously. A few additional solid state amplifier modules provide adequate redundancy in the event that a solid state amplifier module in the primary system fails. In the example given for the invention, the total excess power is 22-½ watts compared to 45 watts excess power for the existing TWTA systems and approximately 32 watts extra standby or backup power compared to 60 watts of standby power in the TWTA system. In as much as the active amplifier power required in this solid state system is approximately half that required by the TWTA systems, the dc power system efficiency is relatively high. This advantage is increased if more than two transmitter signals are required in the communications system. For example, if a three carrier signal system uses the 2-½ watts to 25 watt levels than a total of 30 watts of output power is required for the system of the invention as compared to 75 watts for existing TWTA systems. In a satellite system the conservation of electrical power is especially desirable for obvious reasons.

In the foregoing discussions of the preferred embodiment of FIG. 1, the system was arranged to amplify two carrier signals. The antenna arrangement illustrated in FIG. 2 was illustrative of corresponding antenna arrangements.

Figure 4:
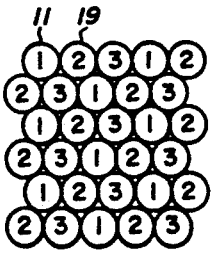
FIG. 4 illustrates the antenna array of FIG. 2 when used with three RF carriers.

As described the system is adapted for use with more than two frequencies by suitable adjustment in accordance with the foregoing principles. By way of example, FIG. 4 illustrates the electronic distribution of a single physical antenna array for use with three frequencies. Those antenna elements assigned to the first frequency are represented by the number 1, those with the second frequency by the number 2, and those with the third by the number 3. The array given that distribution forms three thinned arrays.

Figure 5:
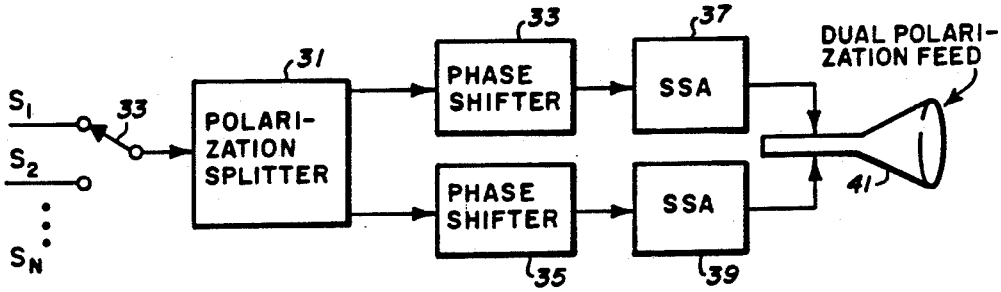
FIG. 5 illustrates in block diagram form a modification to an element of the combination of FIG. 1 that provides dual polarized radiant energy output.

The invention can also be used for dual polarization, which provides RF beam isolation. The arrangement for such a system is represented in block diagram form in FIG. 5. In such a system the element modules include a polarization splitter 31, the input of which is selectively applied to one of the sources sl through sn by input selector switch 33, and the outputs of which are inputted to separate phase shifters 33 and 35 and then to associated solid state amplifiers 37 and 39, respectively. The output of those amplifiers are inputted to the two inputs, respectively, of a dual polarization feed horn 41. The relative phase between the phase shifter 33 and 35 is maintained a constant to provide the required feed horn phase of the two identical but phase shifted signals to achieve the desired dual polarized radiated signal.

Figure 6:
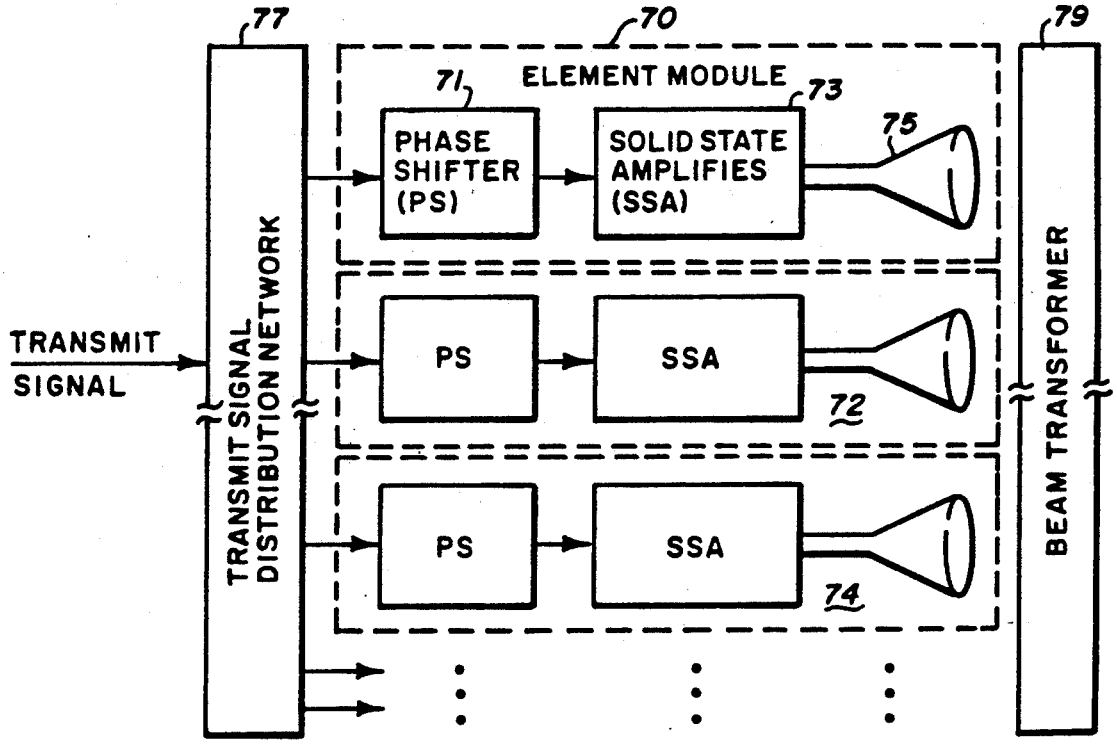
FIG. 6 illustrates in block diagram form a solid state feed array typical of existing phased arrays for a single signal.

An elemental system according to the invention is illustrated in FIG. 6 in block diagram form. This contains a series of modules, suitably nineteen by way of example, only three of which are represented as modules 70, 72 and 74. Each of the modules includes a controllable signal phase shifter 71, which is controlled by associated conventional circuitry, not illustrated, to set the amount of phase shift, a solid state RF amplifier, such as amplifier 73, which amplifies signals applied to the amplifier's input and supplies the amplified signal at the amplifier's output. The amplifiers output is connected to the input of an associated RF feed horn, such as feed horn 75, which outputs the RF radiation. The output of the particular amplifier illustrated may be combined with the outputs of the other RF amplifiers in a conventional beam transformer 79, symbolically illustrated in the figure. The individual feed horns associated with the outputs of the RF amplifiers presented in FIG. 6 are grouped together to form the geometrical antenna arrangement depicted symbolically in front view in FIG. 7.

Figure 7:
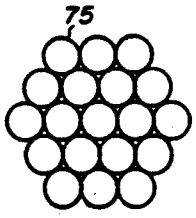
FIG. 7 illustrates a layout of a 19 element antenna array used with the embodiment of FIG. 6.
Figure 3:
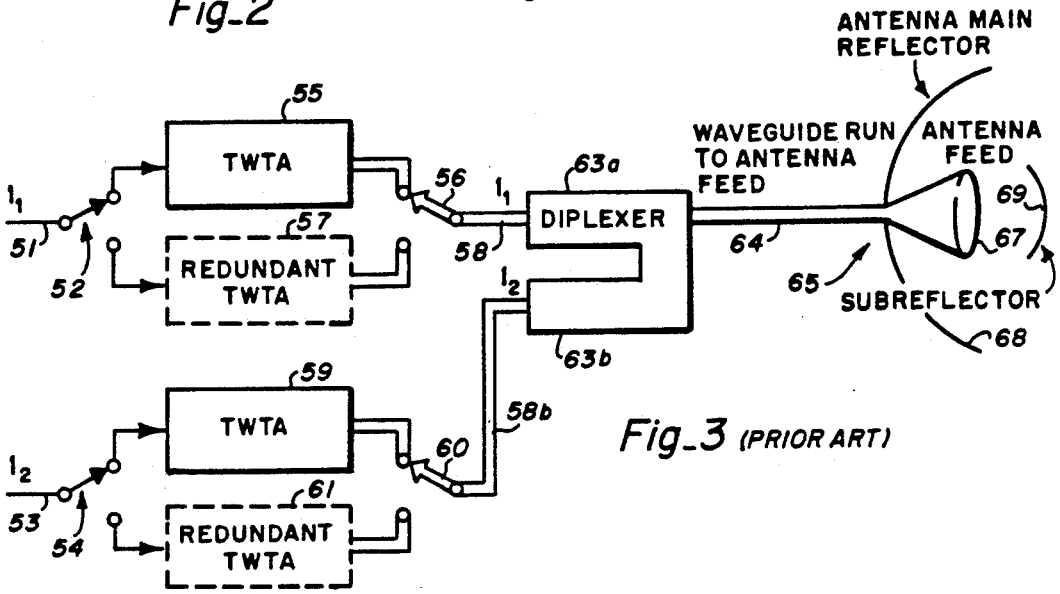
Fig 3 (PRIOR ART)
FIG. 3 is a block diagram of a prior art TWTA communications downlink system.

Those skilled in the art recognize that the structure of FIGS. 6 and 7 may be substituted as a direct replacement for a single element traveling wave tube amplifier arrangement depicted earlier herein in FIG. 3. Any number of feed elements can be arranged in a multitude of arrangements depending on the RF radiation beam shape desired. The arrangement of FIGS. 6 and 7 serves to illustrate one example.

In operation of this embodiment the RF signal to be transmitted is supplied by the other equipment, the details of which are not relevant to the present device, to the input of the distribution network, symbolically illustrated. In turn the distribution network divides the inputted signal among the inputs to the respective module inputs and in those modules is inputted into the associated phase shifter circuit, such as phase shifter 71 in module 70. If the phase of all of the phase shifters is set to the same phase value, then the radiating phase from each element is identical and the signal power from each element spatially sums to form a beam which is directed in a forward reference direction and whose total radiated power is equal to the sum of the radiated power of the individual modules illustrated. The exact geometric configuration of feed array, subreflector/reflector or lens determines the reference direction for each antenna system. If the phase shifters are configured or commanded to provide phase shifts that are different relative to one another, then the beam can be directed or made to point in a different direction than the relative reference direction. By continuously varying the phase shifts, the radiated beam may be made to scan or sweep through a number of directions relative to the reference direction in which the phase shifts of each module are the same.

As is apparent to the skilled reader, the embodiment of FIGS. 6 and 7 possess some advantages over the prior art system illustrated earlier in FIG. 3, but does not contain all of the advantages presented in the embodiment illustrated in FIG. 1, which was earlier discussed. The embodiment of FIG. 6 achieves higher reliability than the prior art system by allowing for inclusion of a number of spare modules; it is capable of being programmed to vary the power transmitted; and avoids the waveguide run losses inherent in the TWTA system to thereby provide higher efficiency than the TWTA system; and allows for efficient spatial combining of signals using a single antenna system.

It is believed that the foregoing description of the preferred embodiment of the invention is sufficient in detail to enable one skilled in the art to make and use the invention. However, it is expressly understood that the details of the elements which are presented for the foregoing enabling purpose is not intended to limit the scope of the invention, in as much as equivalents to those elements and other modifications thereof, all of which come within the scope of the invention, become apparent to those skilled in the art upon reading this specification. Thus the invention is to be broadly construed within the full scope of the appended claims.

What is claimed is:

1. In a downlink communication system for propagating RF signals within a predetermined frequency range of f1 through fn, the combination comprising:

electronically steerable phased array directional antenna means for radiating RF energy in selected directions; said antenna means containing a plurality of feeder antennas of substantially identical geometry that are spatially arranged into an array; said plurality having the capability of being assigned into a number of groups with each such group of feeder antennas comprising at least two feeder antennas and with each such group of feeder antennas having the capability of radiating a steerable beam of RF energy in selected directions independent of the other groups; and each said feeder antenna in said plurality of being capable of transmitting energy within said predetermined frequency range;

input means for inputting RF signals from an RF signal source means for providing RF carrier signals of at least N carrier frequencies, said RF source means comprising a plurality of N RF signal sources of discrete frequencies within said predetermined frequency range f1 through fn, where N is a positive number greater than the number one, including:

first signal source means of frequency f1 for providing RF output at frequency f1;

second signal source means of frequency fn−1 for providing RF output at frequency f2;

N−1th signal source means of frequency fn−1 for providing RF output at frequency fn−1; and Nth signal source means of frequency fn for providing RF output at frequency fn;

a plurality of solid state RF amplifier means, said plurality being at least as great in number as the number of said feeder antennas; and each of said feeder antennas having associated therewith a corresponding one of said solid state RF amplifier means, with the output of the associated RF amplifier means being coupled to the input of the associated one of said feeder antennas;

a plurality of phase shifter means with each of said phase shifter means having an input for receiving RF and an output coupled to an associated one of said plurality of solid state RF amplifier means for controlling the phase of signals applied to an input of said respective amplifier means;

switching means for individually selectively connecting at least two of said plurality of RF sources to a selected plurality of different ones of said phase shifter means, whereby each of said RF sources provides an RF signal to a number of phase shifter means and thereby defines corresponding groups of antenna means from said plurality of antenna means, said groups corresponding in number to the number of said selectively connected RF sources for producing multiple steered RF beams of different frequency and whereby the RF power radiated at the particular frequencies of said connected ones of said plurality of RF signal sources may be changed; each one of said feeder antennas in said plurality being coupled in circuit through said associated amplifier means and phase shifter means to a single one of said connected ones of said plurality of RF signal sources at a given time.

2. The invention as defined in claim 1 further including at least one additional RF source means for producing RF of frequency fk, where k is any number between 2 and N, whereby said system includes two sources of frequency fk, said additional source being connected to said switching means for radiating increased power at frequency fk.

3. In a satellite telecommunications system an RF radiating system comprising:

a plurality of RF carrier sources for providing RF carrier signals of at least two different frequencies;

phased antenna array means capable of radiating at least two individually steerable beams of RF with one beam being of a different RF carrier frequency than the other;

said phased antenna array means including:

a plurality of substantially identical radiating elements spatially arranged about a predetermined space, said plurality being substantially greater in number than said plurality of RF carrier sources;

a plurality of substantially identical discrete solid state amplifier means with individual ones of said plurality of solid state amplifier means being associated with a respective one of said plurality of radiating elements for amplifying RF signals in the frequency range of said plurality of RF carrier sources and applying said amplified RF signal to the respective associated one of said plurality of radiating elements; and a plurality of phase shifter means, with individual ones of said plurality of said phase shifter means being associated with an input of a respective one of said amplifier means;

a plurality of selector switch means, each said selector switch means having a multiple input and an output for selectively coupling one of said inputs to said output, with individual ones of said plurality of said selector switch means inputs being connected to respective ones of said RF carrier source means, whereby said RF carrier sources are each coupled to multiple ones of said selector switch means, and with individual ones of said plurality of selector switch means output being connected to an input of an associated one of said phase shifter means, whereby each of said two RF carrier sources may simultaneously provide RF signals in common to more than one of said plurality of radiating elements independent of the radiating elements to which RF signals are applied from any other of said plurality of RF carrier sources and whereby the RF power radiated at the respective carrier source frequencies may selectively be changed.

4. In a satellite telecommunication system an RF energy propagating system capable of radiating a multi-power level steerable RF beam of a given carrier source frequency and of alternatively radiating simultaneously a plurality of discrete carrier source frequencies in individually steerable RF beams, comprising:

a plurality of individual RF carrier sources for producing RF carriers of different frequencies;

phased array antenna means, including as elements thereof a plurality of antennas;

a plurality of solid state RF amplifiers, one for each said antenna within said phased array antenna means;

a plurality of phase shifting means, one for each of said amplifiers to define a plurality of phase shifting and RF amplifier pairs;

each of said phase shifting means being adjustable;

each of said antennas, phase shifting means and amplifier means being capable of handling frequencies within the range of said RF carrier source frequencies;

dc power supply means for supplying current to said amplifier;

a plurality of switching means, with each of said plurality of switching means being associated with a corresponding one of said plurality of phase shifting means and amplifier pairs and being associated with all said plurality of RF carrier sources;

first control means for controlling said phase shifter means;

second control means for selectively controlling dc power to said solid state amplifier means;

each of said plurality of switching means having a plurality of inputs and an output for selectively coupling a selected one of said inputs of said output, said plurality of inputs corresponding in number of said plurality of individual RF carrier sources with each of said plurality of inputs being connected to a corresponding one of said plurality of individual RF carrier sources to permit a selected one of said RF carrier sources to be coupled to said output of the respective switching means and with said plurality of switching means inputs being less in number than said plurality of antenna elements;

said plurality of antennas being spatially arranged covering a predetermined area; and control means for selectively individually controlling said plurality of switching means, whereby the RF power radiated at any given carrier frequency may selectively be changed.

5. In a satellite telecommunications system an RF system for transmitting modulated RF comprising in combination:

at least first and second RF carrier sources for producing first and second modulated RF carriers of first and second frequencies;

a plurality of RF modules, each of said RF modules containing input means, adjustable phase shifting means coupled to said input means for receiving RF, solid state amplifier means coupled to said phase shifting means for amplifying RF signals applied from said phase shifting means, and antenna feed element means coupled to said solid state amplifier means for radiating RF supplied by said amplifier means;

said plurality of feed element means being physically grouped together to form a radiating array capable of producing at least two directional radiation beams; and distribution network means for selectively coupling RF carrier signals applied at an input to each of the inputs of said plurality of RF modules;

said distribution network including a plurality of inputs individually coupled to said first and second RF carrier sources for inputting said first and second modulated RF carriers and a plurality of outputs selectively coupling said first RF carrier to a number of said individual module inputs and coupling said second RF carrier to different ones of said individual module inputs; whereby said RF system produces at least two directional beams of different frequency and the amount of amplification provided to the respective RF carrier signal may be selectively varied by changing the number of said modules to which the respective RF carrier signal is applied.

6. The invention as defined in claim 5 wherein said radiating array includes: beam transformer means for combining outputs of said antenna feed element means.

* * * * *